US007347289B2

(12) United States Patent
Lee

(10) Patent No.: US 7,347,289 B2
(45) Date of Patent: Mar. 25, 2008

(54) DART-OPERATED BIG BORE BY-PASS VALVE

(76) Inventor: Paul Bernard Lee, 15 Blueridge Pl., Calgary (CA) T3L 2NS ( * ) Notice: Subject to any disclaimer, the term of this patent is extended or adjusted under 35 U.S.C. 154(b) by 153 days.

(21) Appl. No.: 10/527,969

(22) PCT Filed: Aug. 29, 2003

(86) PCT No.: PCT/GB03/03770

§ 371 (c)(1),
(2), (4) Date: Sep. 16, 2005

(87) PCT Pub. No.: WO2004/022906

PCT Pub. Date: Mar. 18, 2004

(65) Prior Publication Data

US 2006/0108152 A1 May 25, 2006

(30) Foreign Application Priority Data

Sep. 3, 2002 (GB) ..... 0220445.1

(51) Int. Cl.
*E21B 34/14* (2006.01)

(52) U.S. Cl. ..... 175/317; 166/318; 175/237

(58) Field of Classification Search ..... 175/237, 175/317, 324, 232; 166/318
See application file for complete search history.

(56) References Cited

U.S. PATENT DOCUMENTS 2,307,983 A * 1/1943 Barnes ..... 166/135
3,814,180 A 6/1974 Oliver
3,989,114 A 11/1976 Tschirky et al.
4,176,717 A * 12/1979 Hix ..... 166/289
4,733,723 A * 3/1988 Callegari, Sr. ..... 166/51
2006/0124310 A1* 6/2006 Lopez de Carenas et al. ..... 166/313
2006/0207765 A1* 9/2006 Hofman ..... 166/313

FOREIGN PATENT DOCUMENTS

EP 1295373 11/1972
WO WO 99/22114 5/1999
WO WO 01/06086 1/2001

* cited by examiner

*Primary Examiner*—Kenneth Thompson
(74) *Attorney, Agent, or Firm*—Kirton & McConkie; Evan R. Witt

(57) ABSTRACT

A by-pass tool is provided which has a large bore through-flow passage when in an inactive drilling mode, and which is capable of being activated upon launching of an activation dart from the surface, to an active mode in which drillstring fluids can be diverted to a by-pass port. The by-pass tool includes a casing, a by-pass port for diverting drillstring fluids when the tool is in the active mode, and an axially slidable member placed within the casing to slide between blocking and release positions with respect to the by-pass port. The slidable member may be moved to the release position by the dart to bring ports in the slidable member into registry with the by-pass port. This slidable member may also return to its blocking position and thereby cause the tool to revert to its inactive mode upon wireline retrieval of the dart.

9 Claims, 2 Drawing Sheets

DART-OPERATED BIG BORE BY-PASS VALVE

BACKGROUND OF THE INVENTION

This invention relates to a dart-operated big bore by-pass tool for use in a drill string.

Some drilling operators require a circulation tool with a large through-bore to allow for retrieval of MWD probes and nuclear sources, but this can cause difficulties when there is a requirement, which arises from time to time during drilling, to by-pass the flow of fluids in the drillstring by directing the fluids through one or more by-pass port.

It is already known from U.S. Pat. Nos. 4,889,199 and 5,499,687 to provide a by-pass tool which has an axially displaceable sleeve (which is spring-loaded to an inactive position in which it blocks communication between the interior of a drillstring and one or more by-pass port) so as to allow normal flow of fluids lengthwise of the drillstring. However, a valve seat is provided which is arranged to receive a deformable activation ball (launched from the surface and travelling down the drillstring), and which then creates a pressure build-up resulting in the valve seat and the sleeve moving downwardly so as to uncover the by-pass port and allow by-pass flow of fluids. The tool therefore can be ball-activated so as to take-up an active by-pass mode.

When it is required to re-set the tool, a smaller hard ball is launched from the surface and which forces the larger and deformable activation ball (used to activate the tool) through the valve seat so that the sleeve then returns to its original position (covering the by-pass port).

BRIEF SUMMARY OF THE INVENTION

The present invention addresses the problem of how to provide a by-pass tool which can work in a large or big bore system to permit retrieval of objects down hole, but which can divert the flow of drillstring fluids through a by-pass port when required.

According to the invention there is provided a by-pass tool for incorporation in a drill-string to provide a large bore throughflow passage for drillstring fluids and to permit retrieval of large objects downhole, when the tool is in an inactive drilling mode, and in which the tool is capable of being activated, upon launching of an activation dart from the surface, to an active mode in which drillstring fluids can be diverted to a by-pass port, and in which the tool comprises:

a casing defining a large bore throughflow passage;

a by-pass port for diverting drillstring fluids when the tool is in the active mode; and, an axially displacable member mounted for slidable movement within the casing between blocking and release positions with respect to the by-pass port, said member being movable to the release position upon activation of the tool by the dart;

in which the tool is capable of reverting to its inactive mode by return movement of the dart.

Preferably, the axially displacable member is movable to the blocking position by wireline retrieval of the dart.

A latch mechanism may be provided and which is arranged to maintain the tool in its inactive drilling mode by restraining the axially displacable member against movement from its blocking position, such latch mechanism being unlatched upon activation of the tool by the dart.

The latch mechanism may include a laterally deformable collet which engages with a top sub-sleeve in the blocking position of the axially displacable member, and which is allowed to move laterally outwardly, to allow the axially displacable member to move to the release position upon engagement of the dart with the collet.

A spring retainer may form part of the latch mechanism, and defines a recess to receive the collet, when the latter deforms outwardly, such retainer being spring biassed to co-operate with the collet.

The top sub-sleeve may be biassed by a less powerful spring than a spring provided to bias the spring retainer.

When the axially displacable member is in the release position, preferably it brings an outlet port thereof into registry with the by-pass port, to allow drillstring fluids to be diverted outwardly, preferably radially outwardly, through the by-pass port when the tool is activated by a surface launched dart to the active mode.

The surface launched dart preferably has a profile which engages a corresponding profile on the collet, in order to activate the tool.

Therefore, during operation of a preferred embodiment of the invention, a circulation tool with a large throughbore is provided for retrieval of objects down hole, such as MWD probes and nuclear sources.

Activation of the tool is achieved by dropping a retrievable dart. Re-setting the tool is achieved by retrieving the dart, down hole or on the surface. A unique latch mechanism is provided which can be set-up to release, or activate, at the desired pressure of the operator. The tool can be arranged to re-set with 200 lb of pulling force on the dart.

The tool is useful to operators by allowing an operator to pump any pumpable material, or achieve maximum flow rates at any time by dropping the dart. To resume drilling, it is simply necessary to use a rig wireline to retrieve the dart and then cause re-setting of the downhole tool.

The tool is also very useful for tripping so-called "dry pipe". With the dart dropped, and the tool activated to an open condition, pull out from the hole can result in the drillstring draining through the ports. When the tool reaches the surface, the connection of the top of the tool to the drillstring can be broken, and easy removal of the dart can be accomplished, resulting in re-setting of the tool. This is a simple and fast procedure. Rocking back of the tool simply re-sets it.

BRIEF SUMMARY OF THE DRAWING

A preferred embodiment of dart operated big bore by-pass tool according to the invention will now be described in detail, by way of example only, with reference to the accompanying drawings, in which.

DETAILED DESCRIPTION OF THE INVENTION

Figure 1:
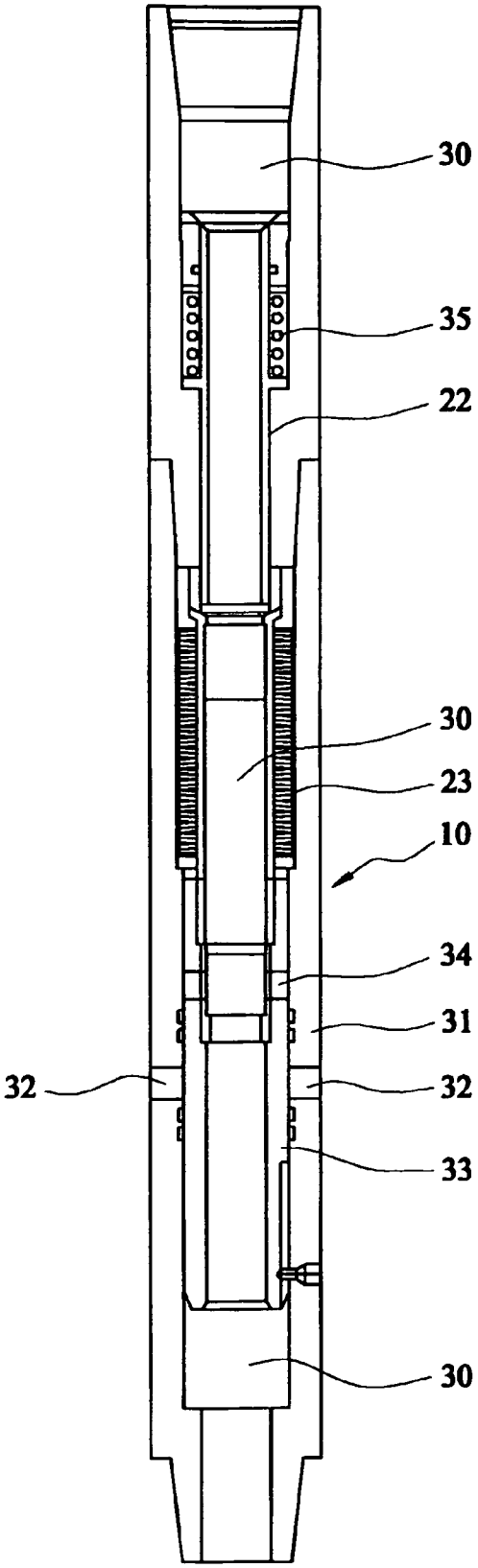
FIG. 1 is a side view, partly in section, of a by-pass tool according to the invention incorporated in a drillstring and with the tool taking-up an inactive mode suitable for drilling and providing a large through passage for drillstring fluids.

Referring to the drawings, a by-pass tool according to the invention is designated generally by reference 10 and is incorporated in a drillstring, and provides a large through bore or passage 30 for drillstring fluids, and also to allow retrieval of large objects down hole, such as MWD probes and nuclear sources.

Figure 2:
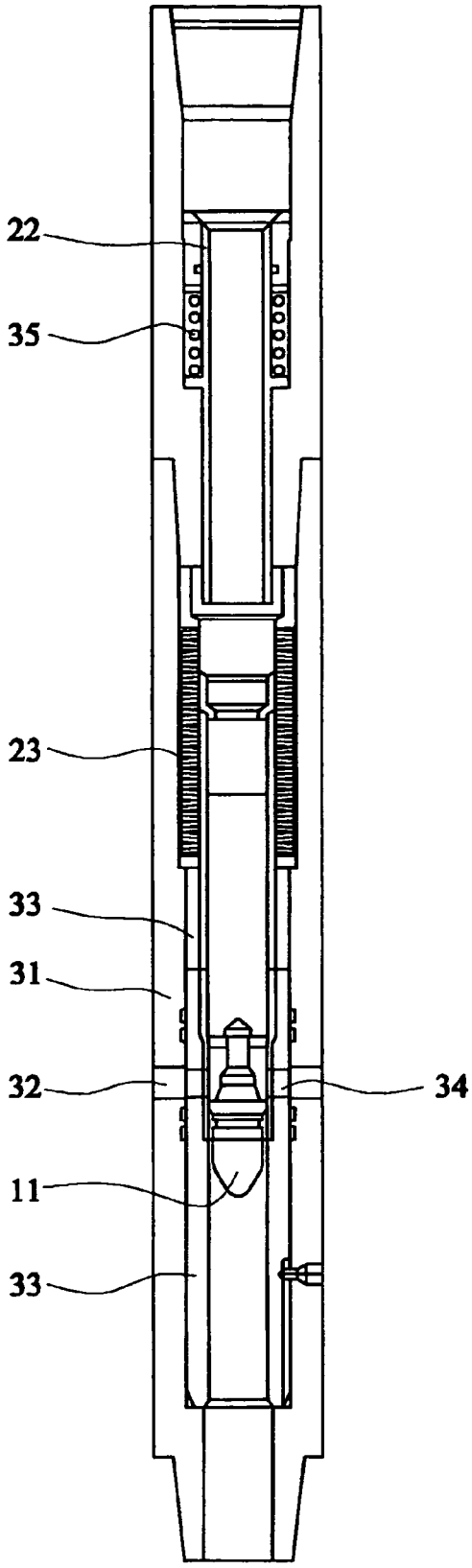
FIG. 2 is a similar view of the tool, but after activation to an active by-pass mode by a surface launched activation dart.

The tool is shown in FIG. 1 in an inactive mode (allowing throughflow of drilling fluids), and in FIG. 2 is shown in an activated position after launch of an activation dart 11. The tool 10 has an outer casing 31 with a by-pass port 32, and an axially displaceable member 33 is provided in the tool which can cause blocking or release of access from the interior of the tool to the by-pass port 32, the member 33 being displaced following launch of the activation dart so as to release access to the by-pass port 32.

FIG. 1 shows the member 33 blocking access to the by-pass port 32 (to allow big-bore throughflow of drilling fluids), whereas FIG. 2 shows the activated position of the tool 10, in which member 33 is downwardly displaced by the dart 11 so as to communicate the interior of the tool with the by-pass port 32 via ports 34 in the member 33 which are moved longitudinally into register with the by-pass port 32.

The tool is also capable of reverting to its inactive mode by wireline retrieval of the dart 11, or upon removal of the dart after the tool has been returned to the surface.

Figure 3:
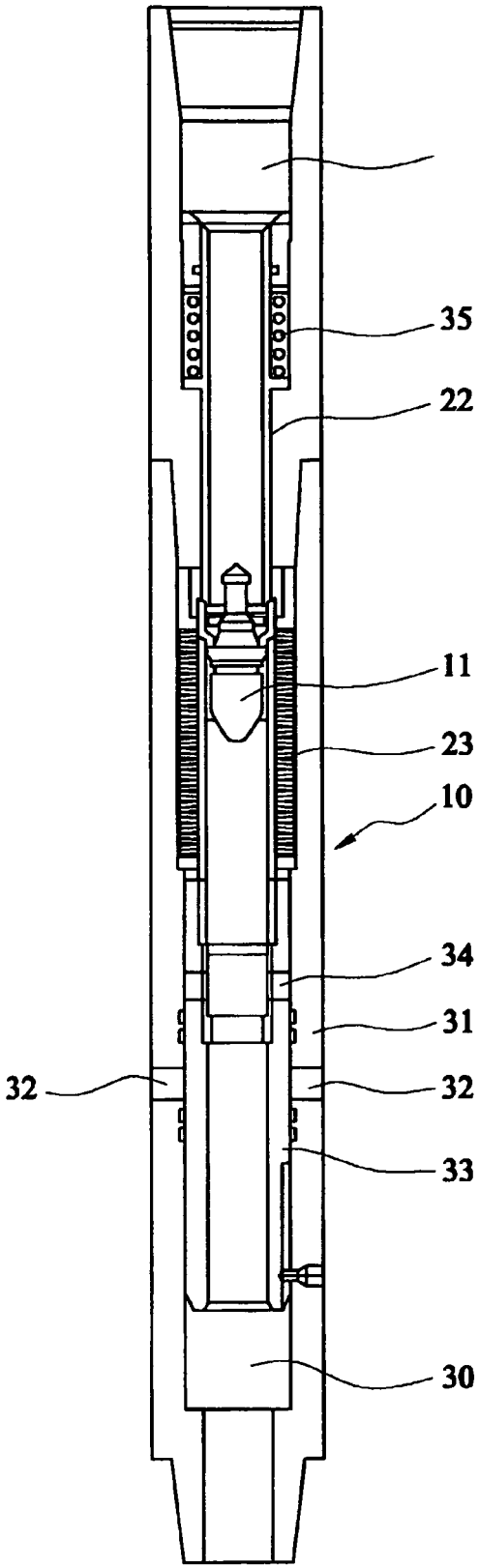
FIG. 3 shows the tool upon initial engagement with the tool by the activation dart; and, FIGS. 4 and 5 show in detail the interaction between the activation dart and the tool components, respectively, during (a) dart launch to activate the tool and (b) dart retrieval to re-set the tool.
Figure 4:
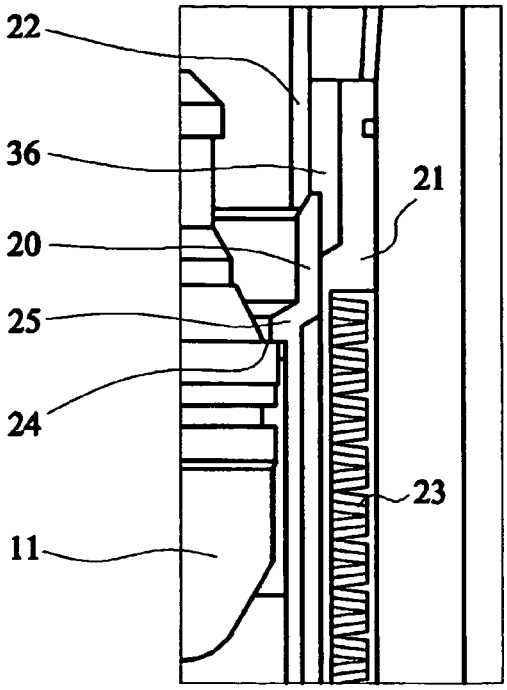
Figure 5:
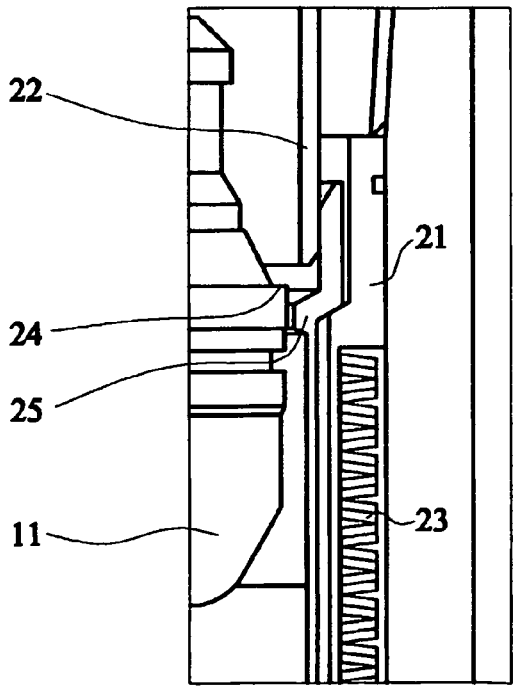

FIG. 3 shows the dart 11 making initial engagement with the tool, following launch from the surface. FIGS. 4 and 5 show, to an enlarged scale and in detail, the interengagement between the dart, during launching to activate the tool, and upon subsequent retrieval of the dart to initiate re-setting of the tool.

Referring in particular now to FIGS. 4 and 5, there is disclosed a unique latch system, as well as a unique positive re-set system, which are simple mechanical arrangements which make the big bore system effective and reliable. During normal drilling, the mandrel is locked in place, and a laterally deformable collet 20 is held between a spring retainer 21 and a top sub-sleeve 22. When dart 11 is launched, downward force is applied to the collet 20, pulling down on the spring retainer 21, compressing its spring 23, until the travel overcomes or moves beyond the top sub-sleeve 22, thereby releasing the collet 20, which moves laterally outwardly to the latched position shown in FIG. 5. In this position of the collet 20, it is received by a recess 36 defined between the retainer 21 and the outer surface of top sub-sleeve 22, and thereby opening the by-pass ports 32, 34.

The tool is simple to re-set, because when the tool reverts to the through-flow drilling position, the diameter of the collet 20 reduces. When the dart is retrieved, by wireline, it is pulled up within the collet 20 until a profile 24 on the top of the dart 11 contacts a profile 25 on the collet 20. Continued pulling on the dart will then push the collet 20 up until it contacts the top sub-sleeve 22. A spring 35, pre-loading the top sub-sleeve 22, is weaker than spring 23 e.g. providing 200 lb pre-loading and the dart 11 will then pull the collet 20, compressing the spring 35 of top sub-sleeve 22 until the collet 20 becomes free to re-set. This arises by lateral inward deformation of the collet to the latched position of FIG. 4. When the collet 20 re-sets, the top sub-sleeve 22 springs down under action of spring 35, locking the collet 20 in position. The collet diameter opens, allowing the dart 11 to be pulled to the surface.

The latch mechanism, provided by components 20, 21 and 22, have a latched position which maintains the tool in the throughflow drilling mode, as shown in FIG. 4. Similarly, there is a further latched position, in the activated mode, as shown by the co-operation between these components in the position of FIG. 5.

It will also be noted from FIGS. 4 and 5 that there is in-line engagement between the lower end of top sub-sleeve 22, and the upper end of collet 20, by way of sliding wedge faces, whereas FIG. 5 shows laterally outward deformation of the upper end of the collet 20 relative to the top sub-sleeve 22.

The invention claimed is:

1. A by-pass tool for incorporation in drillstring to provide a large bore throughflow passage for drillstring fluids and to permit retrieval of large objects downhole, when the tool is in an inactive drilling mode, and in which the tool is capable of being activated, upon launching of an activation dart from the surface, to an active mode in which drillstring fluids can be diverted to a by-pass port, and in which the tool comprises:

a casing defining a large bore throughflow passage;

the by-pass port for diverting drillstring fluids when the tool is in the active mode; and, an axially displacable member mounted for slidable movement within the casing between blocking and release positions with respect to the by-pass port, said member being movable to the release position upon activation of the tool by the dart;

in which the tool is capable of reverting to its inactive mode by return movement of the dart;

the tool further comprising a latch mechanism arranged to maintain the tool in its inactive drilling mode by restraining the axially displaceable member against movement from its blocking position, said latch mechanism being unlatched upon activation of the tool by the dart, wherein the latch mechanism includes a laterally deformable collet which engages with a top sub-sleeve in the blocking position of the axially displaceable member, and which is allowed to move laterally outwardly, to allow the axially displaceable member to move to the release position upon engagement of the dart with the laterally deformable collet.

2. A tool according to claim 1, in which the axially displacable member is movable to the blocking position by wireline retrieval of the dart.

3. A tool according to claim 2, in combination with a surface launchable dart.

4. A tool according to claim 3 in which the dart has a profile to engage a corresponding profile on the laterally deformable collet.

5. A tool according to claim 1, in which a spring retainer forms part of the latch mechanism and defines a recess to receive the laterally deformable collet when the latter deforms outwardly, said retainer being spring biased to co-operate with the laterally deformable collet.

6. A tool according to claim 5, in combination with a surface launchable dart.

7. A tool according to claim 6, in which the dart has a profile to engage a corresponding profile on the laterally deformable collet.

8. A tool according to claim 1, in combination with a surface launchable dart.

9. A tool according to claim 8, in which the dart has a profile to engage a corresponding profile on the laterally deformable collet.

* * * * *